US005661860A

United States Patent [19]

Heitz

[11] Patent Number: 5,661,860

[45] Date of Patent: Sep. 2, 1997

[54] EYE SURGERY RECOVERY APPARATUS

[76] Inventor: Alfred J. Heitz, 2950 E. Dover, Mesa, Ariz. 85213

[21] Appl. No.: 536,001

[22] Filed: Sep. 29, 1995

[51] Int. Cl.[6] ..... A47C 20/00

[52] U.S. Cl. ..... 5/632; 5/630; 5/638

[58] Field of Search ..... 5/638, 622, 636, 5/630

[56] References Cited

U.S. PATENT DOCUMENTS

| | | | |
|---|---|---|---|
| 673,872 | 5/1901 | Von Hillern-Flinsch | 5/636 |
| 1,537,414 | 5/1925 | Darling . | |
| 2,239,003 | 4/1941 | Jones | 5/638 |
| 2,509,086 | 5/1950 | Eaton | 5/636 |
| 3,114,527 | 12/1963 | Demarest | 5/638 |
| 3,413,664 | 12/1968 | Dahlberg | 5/638 |
| 3,608,103 | 9/1971 | Seid | 5/72 |
| 3,694,831 | 10/1972 | Treace | 5/638 |
| 4,054,960 | 10/1977 | Pettit et al. | 5/357 |
| 4,596,384 | 6/1986 | Blosser | 5/638 |
| 4,752,064 | 6/1988 | Voss | 269/328 |
| 4,779,297 | 10/1988 | Sturges | 5/638 |
| 4,908,892 | 3/1990 | Michelson | 5/431 |
| 5,177,823 | 1/1993 | Riach | 5/636 |
| 5,237,713 | 8/1993 | Prager | 5/636 |
| 5,347,668 | 9/1994 | Manning | 5/622 |
| 5,408,713 | 4/1995 | Stratton | 5/632 |

FOREIGN PATENT DOCUMENTS

| | | | |
|---|---|---|---|
| 1061219 | 8/1979 | Canada | 5/638 |

*Primary Examiner*—Flemming Saether
*Assistant Examiner*—Tuyet-Phuong Pham
*Attorney, Agent, or Firm*—Parsons & Goltry; Robert A. Parsons; Michael W. Goltry

[57] ABSTRACT

A device is provided that works in conjunction with conventional home furniture to comfortably support the head of a person who must remain face-down for extended periods of time. A rigid board having an opening in its center is supported above a flat surface by weight-bearing legs. The legs support the board above a support surface such as a bed, table or chairs. A thin-walled, under-inflated ring pillow rests on top of the rigid board. Rings of foam may be stacked on the board under the pillow to raise the pillow to a height appropriate to support the head in comfortable alignment with the spine. The openings of the pillow, foam, and board are aligned so that the patient may rest his face on the cushion and yet still breathe. The present device is used in conjunction with a bed for use while lying in a prone position, or is used in conjunction with a table or chairs for use while in a sitting position.

9 Claims, 4 Drawing Sheets

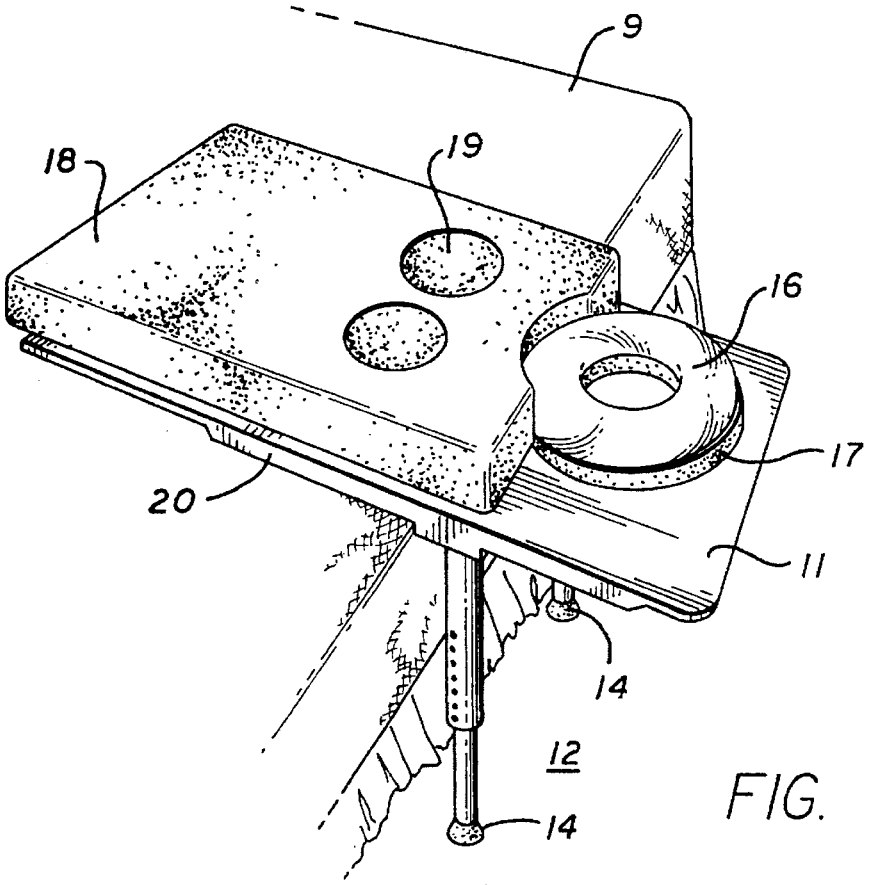
FIG. 1
FIG. 2
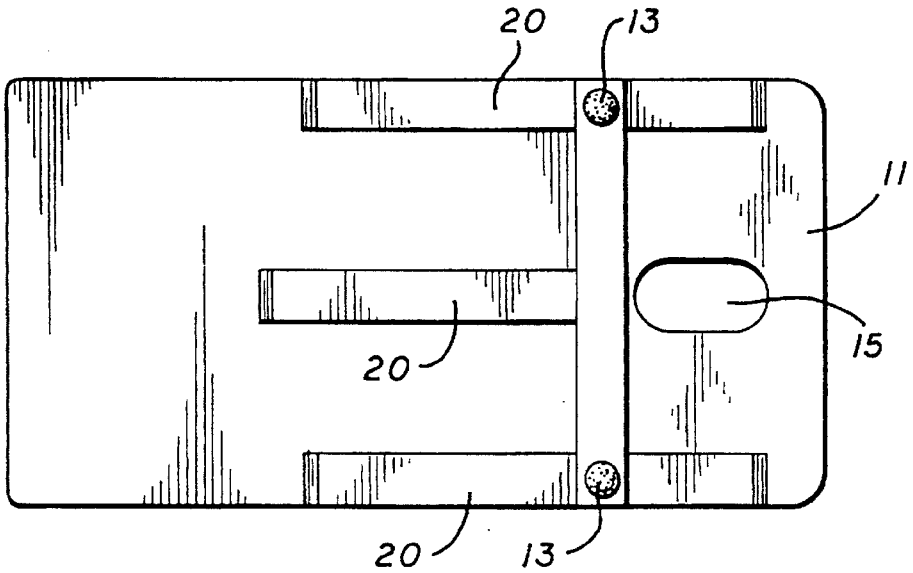

EYE SURGERY RECOVERY APPARATUS

BACKGROUND OF THE INVENTION

This invention relates generally to beds for prone positions, and more particularly an apparatus that allows a patient recovering from eye surgery to comfortably lie face-down on conventional home furniture. Certain eye surgeries require that a gas bubble remain against the back of the eye during recovery. This is achieved by having the patient lie face-down for a prolonged period of time. The present invention is an apparatus designed to provide support for the head and neck while face-down in a variety of positions, in a manner that provides maximum comfort to the patient while recuperating at home. Improved comfort for women is realized by providing a structure that accommodates a patient's breasts while prone.

After eye surgeries wherein the vitreous gel of the eye is removed and replaced with a gas bubble, optimum recovery occurs if the gas bubble is continually maintained in the back of the eye. This is achieved by maintaining a face-down posture twenty-four hours a day for one to four weeks. Liquid fills the front of the eye while the lighter gas floats to the back of the eye when lying prone Unfortunately, however, lying face-down for an extended period of time is not comfortable to most people. When lying face-down on conventional furniture such as a bed or couch it is difficult to breathe because the face is suffocated by the surrounding cushioning. The head and spine are not in comfortable alignment, arm and body positions are restricted, and the skin on the face chafes due to constant Contact with the cushioning. However, if the patient lies on his bed with his head over hanging the edge to allow him to breathe, the head falls below the level of the mattress at an uncomfortable angle. Many women may suffer even more discomfort because it is painful or uncomfortable to lie flat on their breasts.

Various types of equipment have been developed for the commercial or hospital setting where prone positioning is required. For example, U.S. Pat. No. 4,752,064 issued to Voss discloses a head support for face-down positions during surgery. The device is a foam support with a center T-shaped void on which the patient's face rests and through which the patient can breathe. The support can be positioned directly on top of a conventional operating table leaving the head in a higher position than the body, or the support can be attached to a plate extending from the underside of the surgery table so that the head is in a lower position. While performing well for operating tables, the Voss device is not viable for recuperating at home because it is not readily used in conjunction with conventional home furniture. Using this device at home would require putting a disproportionately large surgery table in a patient's home, which is quite discomforting and not conducive to resuming relatively normal activities during recovery. Furthermore, the table will not accommodate a woman's breasts.

A Similar type of apparatus is described in U.S. Pat. No. 5,347,668 which discloses a therapeutic headrest device for use during massage or chiropractic therapy. An inflatable pillow rests on a frame that extends from the head of the therapy table. The pillow is held in place by upwardly-projecting flanges that keep the pillow from sliding about. The pillow and frame have aligned holes through which the patient breathes. Like the Voss device, however, this device is not readily used in conjunction with conventional home furniture and will not accommodate a woman's breasts.

Commercial equipment that is not readily used at home poses several problems. Foremost, without proper equipment the patient is less likely to properly maintain a prone posture keeping the gas bubble at the back of the eye, and is therefore less likely to make full recovery. Second, the cost of using commercial equipment at home is prohibitive. Finally, a full size commercial therapy bed is ungainly and is not easily accommodated in most patients' homes. The combination of these and other factors pose problems for patients who desire to recuperate at home.

Therefore, it is an object of this invention to provide an apparatus that allows a patient to maintain a prone position for extended periods of time so that a gas bubble remains at the back of the eye, aiding recovery from eye surgery. It is a further object of this invention to provide a device that provides uniform pressure to the face which thereby supports the head and neck in comfortable alignment while a person lies face-down. It is another object of this invention to provide an apparatus that achieves comfort for a variety of prone positions. It is another object of this invention to provide recovery equipment that can be readily used in conjunction with conventional home furniture.

BRIEF SUMMARY OF THE INVENTION

The present invention is a device to comfortably support the head of a person who must remain face-down for extended periods of time. The device works in conjunction with conventional home furniture and is therefore convenient to use. The patient rests prone on the present device comprising a rigid board having an opening through which the patient will breathe. A thin-walled, under-inflated ring pillow rests on top of the rigid board. Rings of foam may be stacked on the board under the pillow to raise the pillow to a height appropriate to support the head in comfortable alignment with the spine. The openings of the pillow, foam, and board are aligned so that the patient may rest his face on the cushion and yet still breathe. The device is supported by weight-bearing legs above a support surface such as a bed, table or chairs.

For the patient to fully recline in a prone position the present device is used in conjunction with a bed. A rigid board is placed on the bed with one end of the board over-hanging the edge of the bed; the over-hanging end has an opening through which the patient will breathe. Legs project from the underside of the board to the floor to support the board in horizontal alignment with the bed. For comfort, a cushion that is as long as and slightly wider than the patient's torso is placed on the board. The patient lies face-down on the board, shoulders aligned with approximately the end of the bed, and the face positioned in the hole of the pillow. The patient's hip bones fall in the void created between the end of the torso cushion and the bed. The torso cushion may have holes or depressions that form a cavity to more comfortably accommodate women's breasts. The patient's arms may be rested in several positions.

The patient may also change positions and use the device while in a sitting position. A rigid board having short legs is placed in a horizontal position at approximately chest height on a support structure such as a table or between two chair backs. The patient sits in a chair and places his face on the board. The patient may vary the angle between the head and the spine by moving closer or farther from the apparatus, or by using a taller or lower support structure. With this apparatus a variety of relaxing prone positions may be maintained for extended periods of time.

BRIEF DESCRIPTION OF THE DRAWINGS

FIG. 1 is a perspective view of the present invention showing the apparatus in use with a bed.

FIG. 2 is a bottom view of the planar member shown in FIG. 1.

DESCRIPTION OF THE PREFERRED EMBODIMENTS

Figure 3:
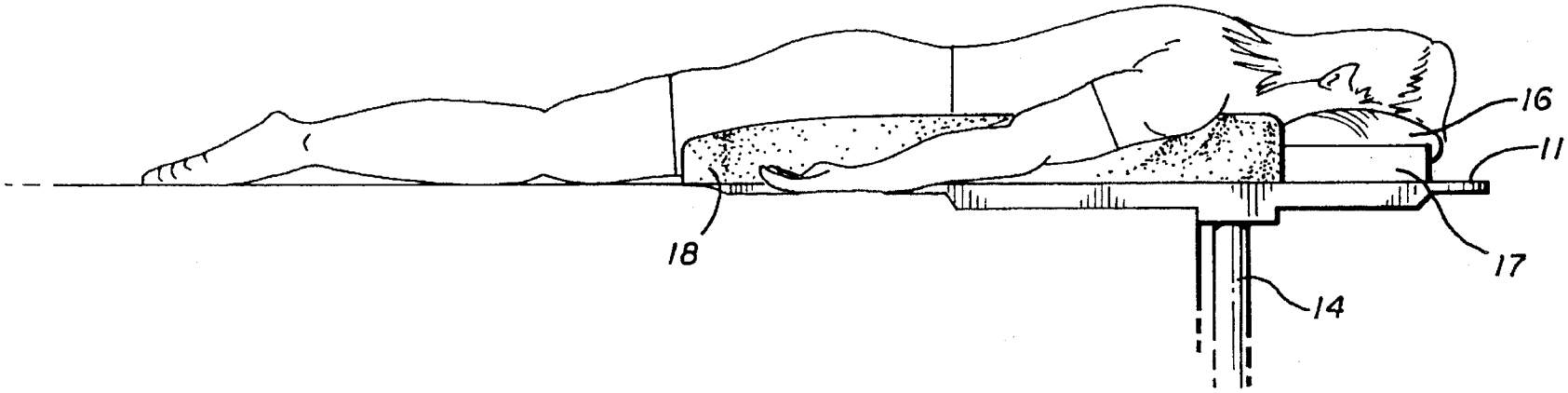
FIG. 3 is a side view of the present invention in use, showing the arms along side the patient's body.

Please refer to the accompanying FIGS. 1–8 where like numerals refer to like parts throughout the drawings. The figures illustrate the present invention comprising a rigid planar member having an opening and a face cushion with complementary openings that rests on the planar member. The patient rests his face on the face cushion with nose and mouth jutting into the conduit formed by the aligned openings. The apparatus is shown in use with various common home furnishings.

FIG. 1 shows a rigid planar member 11 in use with a patient's bed 9. To fully recline, the planar member 11 is positioned on a bed 9 or other comfortable piece of furniture with one end over-hanging the edge. Projections extend from the underside of the planar member 11 to support the planar member 11 above a support surface, in this case the floor 12. FIG. 1 shows long extendable legs 14 projecting from the planar member 11 for supporting it above the floor 12. FIG. 2 shows the underside of the planar member 11 illustrating sites 13 where the projections may be attached. Support spines 20 may be used to strengthen the planar member to better support the weight cantilevered over the edge of the bed.

The planar member includes a first end, a second end coplanar with the first end, and an opening (15) proximate the first end. The opening 15 is cut into the portion of the planar member 11 that hangs over the edge of the bed 9 through which air may flow to a patient lying prone on the apparatus. Preferably the opening 15 is elliptical or an elongated circle so that the face cushion can be positioned at several points along the long axis of the ellipse and still allow air to pass to the face of the patient. A face cushion rests on top of the planar member 11 at a height appropriate to support the head in line with the spine. Preferably the cushion comprises a thin-walled, inflatable ring pillow 16 of soft fabric that will not chafe the patient's face. The pillow 16 can be inflated to varying degrees to customize the cushion for the patient, although a slight under-inflation has proven to be the most comfortable. Rings of foam 17 may be stacked upon the planar member 11 to boost the under-inflated ring pillow 16 to the desired height so that the neck and spine are in comfortable alignment. The openings of the pillow, foam, and board are aligned so that the patient may rest his face on the cushion and yet still breathe.

Figure 4:
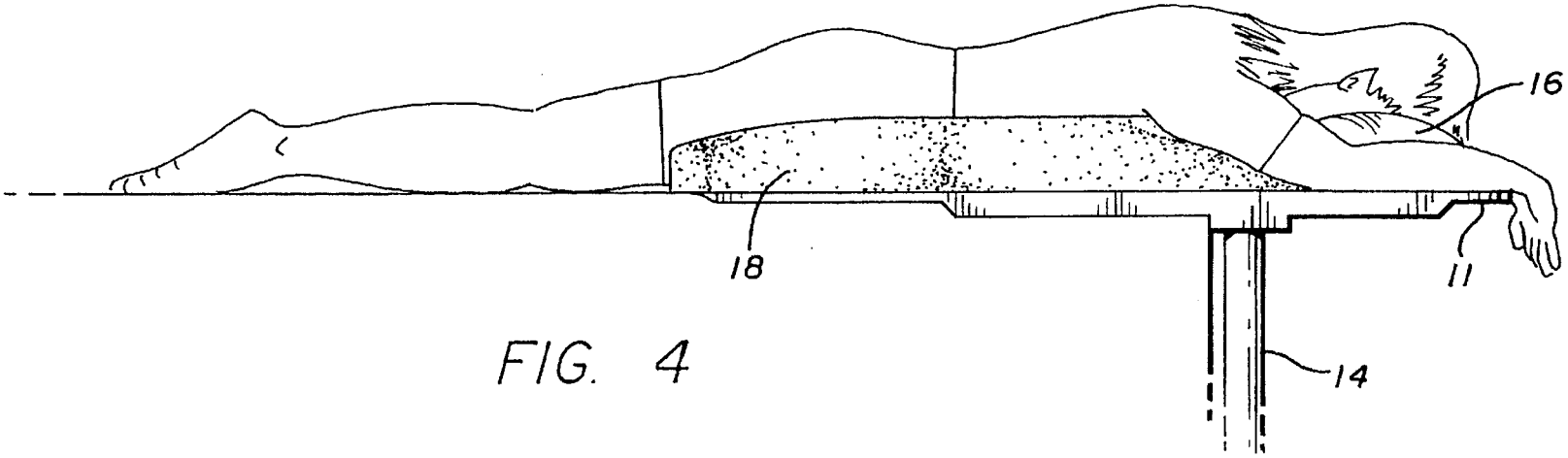
FIG. 4 is a side view of the present invention in use, showing the arms resting on the planar member.
Figure 5:
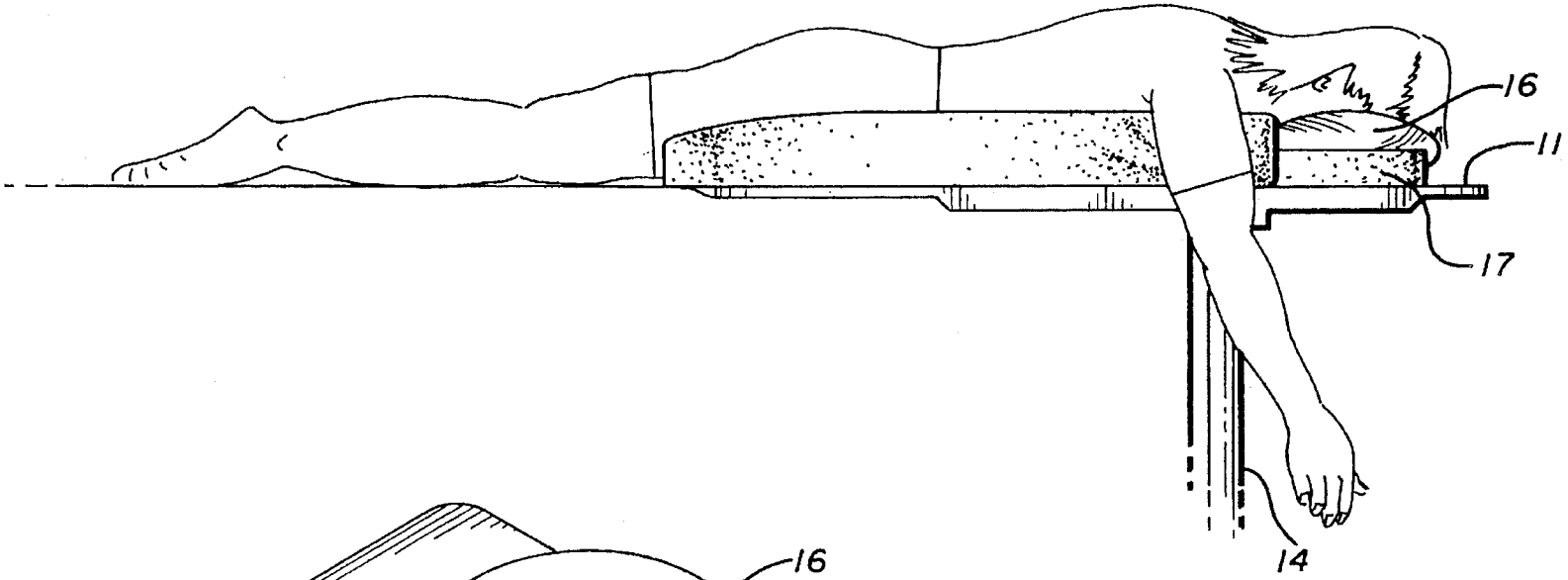
FIG. 5 is a side view of the present invention in use, showing the arms dangling freely.

The planar member 11 is preferably rectangular, approximately as long as and slightly wider than the patient's torso. A torso cushion 18 of approximately the same size is placed on the planar member 11. The torso cushion 18 may be a small mattress but is preferably foam with depressions 19 or a cut-out forming a cavity to accommodate a woman's breasts. The patient lies face-down on the apparatus, shoulders approximately aligned with the edge of the bed, and the face positioned in the opening of the face cushion. The patient's hip bones fall in the void created between the end of the torso support 18 and the mattress. See FIGS. 3–5. The size of the planar member 11 and torso cushion 18 allows the patient to have freedom of arm movement and thereby vary his position, which greatly improves the length of time a patient can lie comfortably. FIGS. 3–5 illustrate some of the various possible positions. FIG. 3 shows the arms resting along the patient's side. FIG. 4 shows the arms resting above the patient's head on the planar member 11. FIG. 5 shows the arms dangling freely from the patient's shoulders below the level of the bed.

Figure 6:
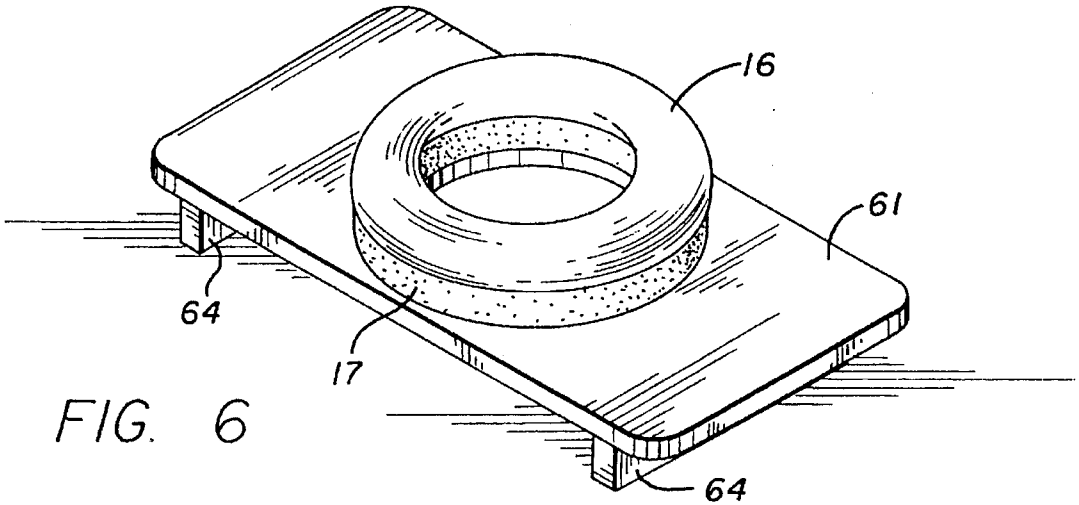
FIG. 6 is a perspective view of the present invention.
Figure 7:
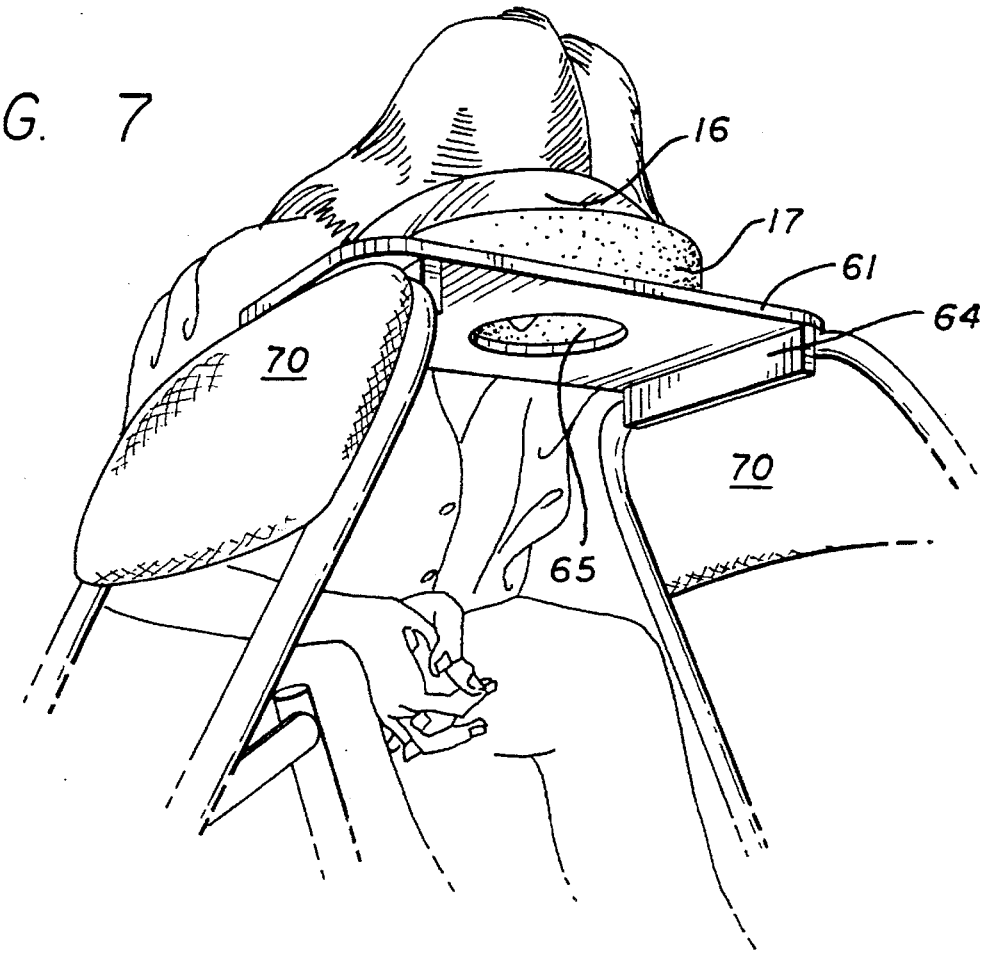
FIG. 7 is a perspective view of the present invention in use, showing the apparatus supported by two chairs.
Figure 8:
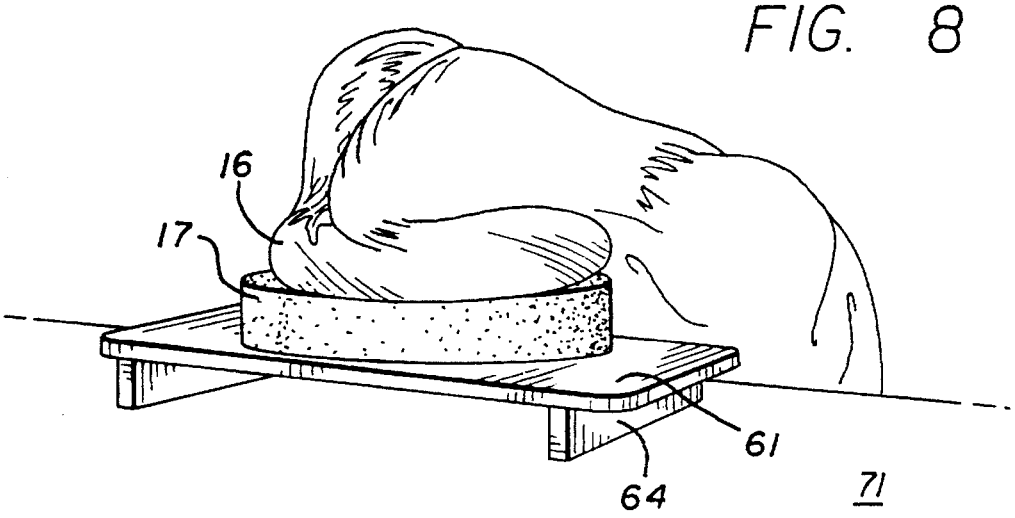
FIG. 8 is a perspective view of the present invention in use, showing the apparatus supported by a table top.

FIGS. 6–8 show a shorter planar member 61 to be used when the patient desires to sit with his face down. Shorter legs 64 support the apparatus between chair backs 70, above a table 71, or other support surface. The shorter legs 64 act as spacers between the planar member 61 and the support surface, allowing air to circulate to the patient's face when it rests on the face cushion. For this shorter planar member 61 a round opening 65 may suffice because, whereas the patient has to position himself relative to the stationary placement of the planar member 61 if it rests on a bed, the shorter planar member 61 shown in FIGS. 6–8 can be easily moved to any desired location relative to the patient.

The present device can be made relatively inexpensively. It is also relatively easy to manufacture and transport. These factors make the device inexpensive and convenient for patients to obtain and use. In addition, the present device is not unwieldy and does not take up space in a home; it can be used with common home furnishings. For example, the device can be used with a bed as in FIG. 1. The device can also be supported between two chair backs 70 as shown in FIG. 7. This is particularly convenient for a living room or kitchen where people congregate and the patient accompanies the gathering. FIG. 8 shows the device in use on a table 71. These various uses allow the patient to vary body position while staying face-down. This freedom of movement allows the patient to be more comfortable while recuperating and thus more likely to remain in a prone position for extended periods of time. This will improve recovery.

The objects of this invention are achieved through the aforementioned improvements. Although certain preferred embodiments have been shown and described, it should be understood that other embodiments and modifications that achieve these objects may be apparent to those of skill in the art and are within the scope of the appended claims.

I claim:

1. An apparatus in combination with a bed for lying prone comprising:

a) a substantially flat, rigid, planar member for supporting a person's head and torso in a same plane, the planar member includes a first end, a second end coplanar with the first end, and an opening proximate the first end for receiving the person's face, the planar member rests on the bed in a substantially horizontal plane with the first end extending beyond an edge of the bed;

b) at least one projection substantially orthogonal to the planar member proximate the first end wherein the projection rests on a support surface carrying the bed thereby supporting the planar member in spaced relation to the support surface and supporting the planar member in substantially horizontal alignment with the bed;

c) at least one face cushion having an opening for receiving the person's face, the cushion resting on the planar member such that the opening of the cushion is substantially aligned with the opening in the planar member; and d) a torso cushion approximately as long and as wide as the person's torso rests on the planar member; wherein the person lies prone on the apparatus with the torso resting on the torso cushion and the face resting on the face cushion such that the head and back are in substantially linear alignment.

2. The apparatus of claim 1 wherein the torso cushion has at least one cavity to accommodate a woman's breasts.

3. The apparatus of claim 1 wherein:

the support structure is a floor and the projection is at least one leg extending from the planar member to the floor.

4. The apparatus of claim 1 wherein the opening in the planar member is elliptical.

5. The apparatus of claim 1 wherein the face cushion further comprises an under-inflated air pillow having an opening for receiving the person's face.

6. The apparatus of 5 wherein the face cushion further comprises at least one foam ring positioned intermediate the planar member and the air pillow having an opening for receiving the person's face.

7. A method of lying prone comprising:

a) placing a substantially flat, rigid planar member having a first end, a second end coplanar with the first end, and an opening proximate the first end for receiving a person's face on a bed carried by a support surface such that the first end extends beyond an edge of the bed;

b) supporting the first end of the planar member on the support surface with at least one projection substantially orthogonal to the planar member proximate the first end;

c) placing at least one face cushion having an opening for receiving the person's face on the planar member such that the opening of the cushion is substantially aligned with the opening in the rigid planar member;

d) placing a torso cushion approximately as long and as wide as a person's torso on the planar member;

e) resting the person's face on the face cushion and the torso on the torso cushion such that the head and back of the person are in substantial linear alignment.

8. A method according to claim 7, further comprising the steps of:

a) providing the torso cushion with at least one cavity to accommodate a woman's breast; and b) resting the person's breast's in the cavity.

9. A method according to claim 7 wherein the step of placing a face cushion includes providing an air pillow having a central opening and partially inflating the air pillow.

* * * * *